US006328229B1

(12) United States Patent
Duronio et al.

(10) Patent No.: US 6,328,229 B1
(45) Date of Patent: Dec. 11, 2001

(54) LOW VOLUME MIXING SPRAY HEAD FOR MIXING AND DISPENSING OF TWO REACTIVE FLUID COMPONENTS

(75) Inventors: James Duronio, Mountain View; Stephen Schoenberg, Belmont, both of CA (US)

(73) Assignee: Cohesion Technologies, Inc., Palo Alto, CA (US)

( * ) Notice: Subject to any disclaimer, the term of this patent is extended or adjusted under 35 U.S.C. 154(b) by 0 days.

(21) Appl. No.: 09/216,080

(22) Filed: Dec. 18, 1998

(51) Int. Cl.[7] ..... B05B 7/10

(52) U.S. Cl. ..... 239/399; 239/106; 239/123; 239/304; 239/492; 239/494; 222/145.5; 604/304

(58) Field of Search ..... 239/398, 399, 239/104, 106, 114, 123, 407, 408, 303, 304, 404, 492, 494; 604/82, 187, 191, 416; 222/137, 145.1, 145.5, 145.6, 149

(56) References Cited

U.S. PATENT DOCUMENTS

| | | | | |
|---|---|---|---|---|
| 2,890,836 | * | 6/1959 | Gusmer et al. | 239/404 |
| 3,563,459 | * | 2/1971 | Kautz | 222/145.5 X |
| 3,746,216 | | 7/1973 | Frederick | 222/137 |
| 4,377,256 | * | 3/1983 | Commette et al. | 239/123 X |
| 4,523,696 | * | 6/1985 | Commette et al. | 239/145.5 X |
| 4,735,616 | | 4/1988 | Eibl et al. | 604/191 |
| 4,867,346 | * | 9/1989 | Faye et al. | 222/145.5 |
| 5,116,315 | | 5/1992 | Capozzi et al. | 604/82 |
| 5,368,563 | | 11/1994 | Lonneman et al. | 604/82 |
| 5,397,059 | | 3/1995 | Baudin | 239/333 |
| 5,478,323 | | 12/1995 | Westwood et al. | 604/191 |
| 5,501,371 | * | 3/1996 | Schwartz-Feldman | 222/137 |
| 5,665,067 | | 9/1997 | Linder et al. | 604/82 |

OTHER PUBLICATIONS

Lefebvre, 1989, "Atomization and Sprays", Hemisphere Publishing Corporation, 105–117.

* cited by examiner

*Primary Examiner*—David A. Scherbel
*Assistant Examiner*—Dinh Q. Nguyen
(74) *Attorney, Agent, or Firm*—Pennie & Edmonds LLP

(57) ABSTRACT

A device for mixing and ejecting a multi-component reactive mixture, which will not clog after a single and subsequent uses, is disclosed. The device has a cylindrical mixing space defined by upper, lower, and side walls. There are two entry ports into the mixing space defined by and tangent to the side wall. Two fluid component sources are fluidly connected to the entry ports and are pressurized such that two fluids, which react with each other, separately enter the mixing space. The side wall of the mixing space imparts a rotational motion to the fluids, which causes the fluids to thoroughly mix together before being ejected out through the exit orifice in either a spray or stream form. A valve stem may be provided, which is configured and dimensioned to substantially occupy the mixing space and to seal the two entry ports when it is in the closed position.

32 Claims, 6 Drawing Sheets

LOW VOLUME MIXING SPRAY HEAD FOR MIXING AND DISPENSING OF TWO REACTIVE FLUID COMPONENTS

FIELD OF THE INVENTION

The present invention relates to the field of mixing and dispensing reactive components. In particular, the present invention relates to an apparatus and method for mixing and dispensing a plurality of fluid components that together form a tissue adhesive, such that clogging of the apparatus is avoided.

BACKGROUND OF THE INVENTION

A surgical adhesive is used in lieu of physical means, such as sutures or staples, to bind together two edges or sides of a laceration. Biologically and non-biologically based surgical adhesives are made by mixing a first reactive fluid component (e.g., fibrinogen) with a second reactive fluid component (e.g., thrombin), which react with each other to harden into the adhesive. Upon contact the two fluid components react relatively quickly, in the order of seconds, to harden into the tissue adhesive. If it is only partially mixed, the adhesive will not sufficiently harden over the entire area to which it is applied thus, resulting in weak spots. It is, therefore, desirable to apply a thoroughly mixed solution to the target site before the solution has gelled or hardened. Furthermore, it is desirable to minimize the amount of time required to thoroughly mix the fluid components together, thereby minimizing the amount of contact time between the two substances prior to delivery to the target site.

Several methods and devices exist for mixing and applying biologically based and synthetic tissue adhesives. One method is to directly apply a layer of the first fluid component to the target site, directly apply a layer of the second fluid component on top of the first fluid component layer, mechanically mix the two fluid components together using a surgical instrument and spread the mixed adhesive over the target area. A variation of this method is to premix the two fluid components, immediately thereafter draw the adhesive mixture into a delivery syringe and apply the mixture to the target site. Both of these methods suffer from multiple deficiencies, not the least of which is that it is very difficult to thoroughly mix the fluid components and apply the mixed adhesive before the adhesive begins to gel and harden, resulting in a nonuniform adhesive layer with weak spots.

More recent devices and methods utilize one device for bringing the fluid components together, mixing the fluid components and applying the mixed adhesive in either an aerosol or a stream form to the target site. The more recent devices and methods can be broken down into two general types: 1) devices that bring the two fluid components together, mix them within the device and then dispense the mixed adhesive; and 2) devices that separately atomize the two fluids outside the device such that the atomized fluids contact and mix together before being deposited on the target site.

An example of the first type is described in U.S. Pat. No. 4,735,616 to Eibl et al. This device has two parallel fluid component syringes fluidly connected to two channels that extend through a manifold into a mixing needle. The two fluid components flow through their respective channels and enter the mixing needle, where they contact for the first time. The high surface area within the mixing needle creates turbulents that cause the fluid components to become thoroughly mixed within the needle. A second example of this type of device is described in U.S. Pat. No. 5,116,315 to Copozzi et al. This device has two parallel fluid component syringes connected to one end of a Y-manifold and a mixing assembly detachably locked onto the second end of the Y-manifold. The mixing assembly has two separate and adjacent parallel channels, each separately fluidly connected to the two fluid component syringes, via the Y-manifold, and both of which terminate into a single annular channel within the mixing assembly. The annular channel is connected to a disk shaped mixing space having three inclined vanes disposed about an exit orifice. In use, the two fluid components pass through the Y-manifold, through the two separate parallel channels in the mixing assembly, through the singular annular channel, where the fluid components first contact and begin mixing, through the mixing space, where the fluid components impinge upon the vanes that impart a spiraling motion to the fluids causing the fluids to become thoroughly mixed, and out of the exit orifice in an atomized spray. A problem experienced with these types of devices is that they typically become clogged after a short period of non-use, because the un-ejected, mixed or partially mixed, adhesive hardens within the device.

An example of the second type of devices is described in U.S. Pat. No. 5,368,563 to Lonneman et al. Similar to the first type of devices, Lonneman et al. disclose a device having two parallel syringes connected to a manifold. However, the manifold has two separate exit orifices adjacent and in close proximity to each other. In use, the two fluid components exit from the corresponding exit orifices in a swirling atomized spray. The atomized fluid components mix with each other while airborne without the need for an internal mixing chamber. While the Lonneman et al. design alleviates the clogging problem of the first type of devices, it has been found that it does not adequately mix the two fluids, particularly at the peripheries of the two atomized spray cones, thus resulting in an adhesive layer having weak spots.

There thus remains a need in the art for a device that can thoroughly mix the reactive fluid components of a tissue adhesive and deliver the mixed adhesive to a target site without clogging after only a single use.

SUMMARY OF THE INVENTION

The present invention is directed towards an apparatus for mixing and ejecting a multi-component fluid mixture, such as a medical adhesive, which will not become clogged after only a single use. The device has a body portion having a mixing space defined therein. The mixing space is defined by at least an upper wall, a side wall and an exit orifice. The side wall defines at least two entry ports to the mixing space. The device further has at least two fluid component sources fluidly connected to the at least two entry ports and a means for forcing the at least two fluid components into the mixing space. The at least two fluid components separately enter the mixing space through the at least two entry ports; the side wall imparts rotational motion to the at least two fluid components; the at least two fluid components become thoroughly mixed into the multi-component fluid mixture; and the multi component mixture exits the mixing space from the exit orifice. Alternatively, a valve stem, with a distal end and a proximal end and movably extending through the body portion into the mixing space, may be provided. The distal end of the valve stem is configured and dimensioned to substantially occupy the mixing space when the stem is in a closed position. In the closed position the distal end seals the at least two entry ports and forces substantially all fluid components remaining in the mixing space out through the exit orifice. In the open position the distal end is withdrawn from the mixing space, thereby allowing the at least two fluid components to enter the mixing space as previously described.

DETAILED DESCRIPTION OF THE PREFERRED EMBODIMENTS

Figure 2:
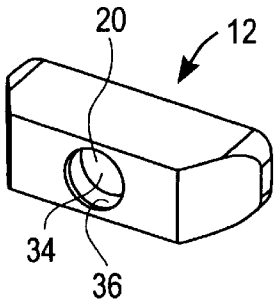
FIG. 2 is a perspective view of the body portion 12 of the embodiment illustrated in FIG. 1.

An embodiment of a medical mixing device 10 in accordance with the principles of the present invention, capable of mixing and delivering a medical adhesive to a target area without clogging after multiple uses, is shown in FIGS. 1–7. Mixing device 10 has a body portion 12, an insert 14, a first fluid component syringe 16 and a second fluid component syringe 18. A handle member 21 may be provided to facilitate simultaneous ejection of the first and second fluid components out of syringes 16 and 18 respectively.

Figure 1:
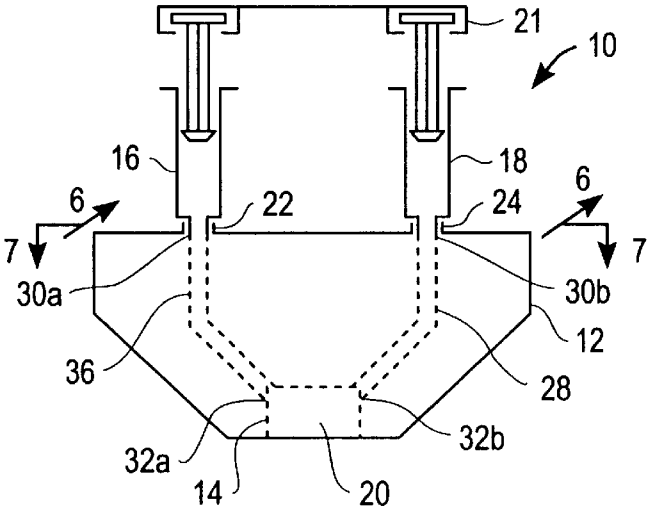
FIG. 1 is a plan view illustrating a device for mixing and spraying a dual component medical adhesive constructed according to the principles of the present invention.

Referring to FIGS. 1 and 2, body portion 12 has a void 20 (best shown in FIG. 2) configured to receive insert 14, two standard luer locks 22 and 24 for detachably connecting syringes 16 and 18, a first conduit 26 and a second conduit 28 extending through body portion 12. Each conduit 26 and 28 has a first end, 30*a* and 30*b*, connected to luer locks 22 and 24, and a second end, 32*a* and 32*b*, connected to void 20. Any suitable fluid connector may be used in place of luer locks.

Void 20, best shown in FIG. 2, is cylindrically shaped and has an upper, substantially planar face 34 and a side face 36 perpendicular to upper face 34. Second ends 32*a* and 32*b* (FIG. 1) of conduits 26 and 28 connect to void 20 at the intersection of side ace 36 and upper face 34 and at opposite ends of a diameter of upper face 34. The skilled artisan will readily recognize that shapes other than cylindrical may be used for void 20 and insert 14, and that conduits 26 and 28 may connect to void 20 in many different locations without deviating from the scope of the present invention.

Figure 4:
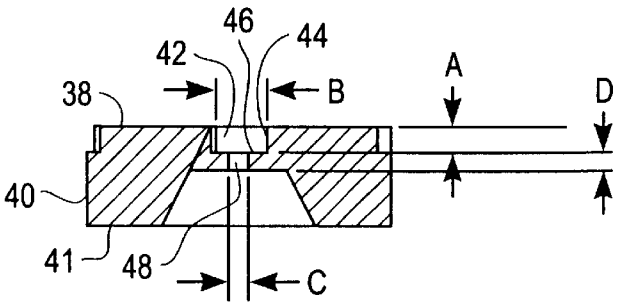
FIG. 4 is a cross-sectional view of the insert shown in FIG. 3.
Figure 3:
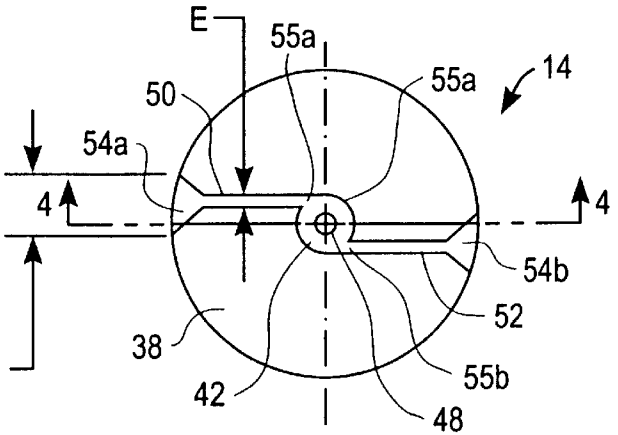
FIG. 3 is a plan view of insert 14 of the embodiment illustrated in FIG. 1.

Referring to FIGS. 3 and 4, insert 14 is a cylindrically shaped piece of suitable material, such as medical grade plastic, that has a substantially planar top surface 38 and a side surface 40. The skilled artisan will readily recognize that shapes other than cylindrical and that material other than medical grade plastic may be used for insert 14 without deviating from the scope of the present invention. Top surface 38 has a cylindrically shaped cavity 42 therein, which is defined by a side wall 44 with thickness A and a bottom wall 46 with diameter B. Bottom wall 46 has an orifice 48 with diameter C and length D (dimensions best shown in FIG. 4). Channels 50 and 52, cut into top surface 38, extend from mouths 54*a* and 54*b*, into cavity 42 at openings 55*a* and 55*b*, which are tangent to side wall 44 and opposite each other. In this embodiment, each of the channels 50 and 52 have the same width E (FIG. 3), and the same height equal to thickness A of side wall 44 (FIG. 4). Mouths 54*a* and 54*b*, which are wider than width E, are provided to facilitate connecting the channels to second ends 32*a* and 32*b* of conduits 26 and 28, as discussed in more detail below. A skilled artisan will readily recognize that the height of channels 50 and 52 may be greater or less than thickness A of side wall 44 and that the width of mouths 54*a* and 54*b* may also be varied without deviating from the scope of the present invention.

Figure 5:
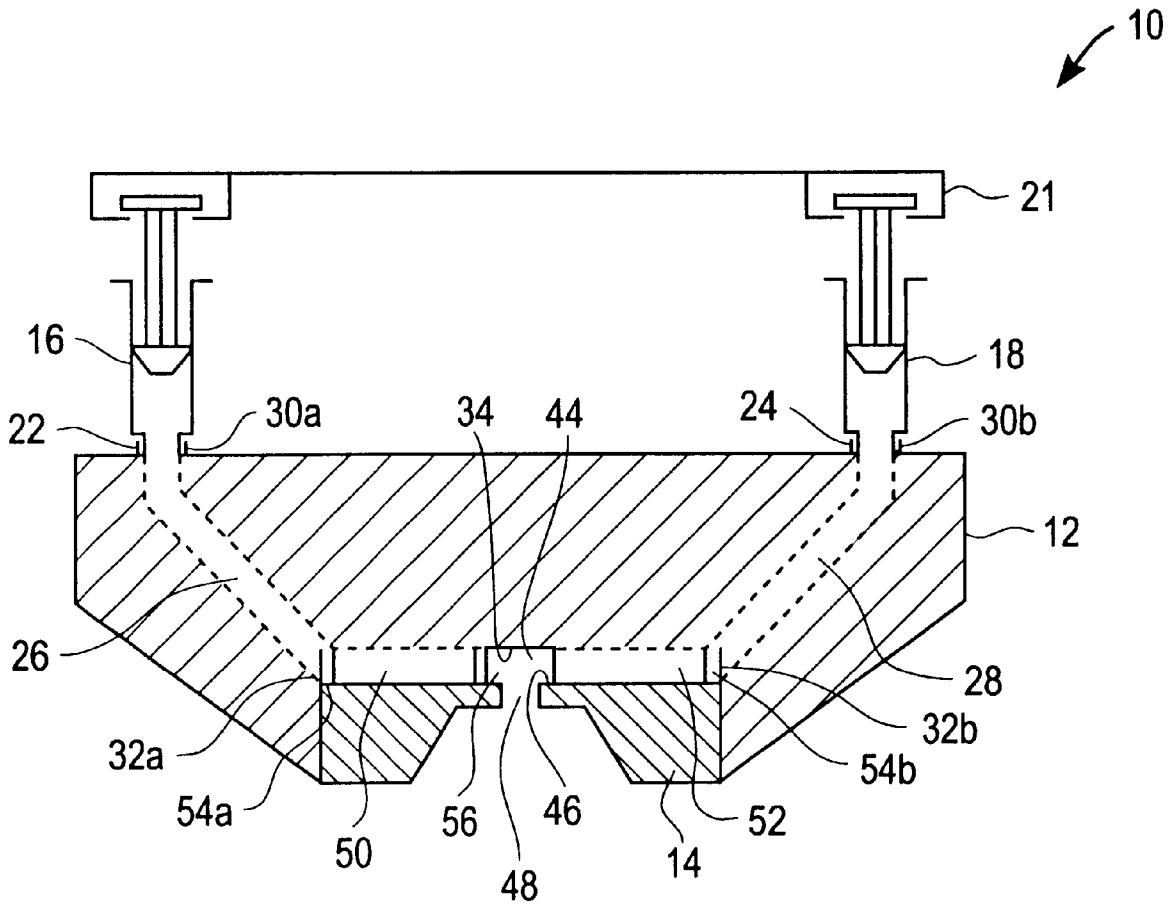
FIG. 5 is a schematic, in cross-sectional view, of the embodiment of the present invention illustrated in FIG. 1.

Referring to FIG. 5, insert 14 fits into void 20 (FIG. 2) such that bottom wall 46, side wall 44 and upper face 34 define a cylindrical mixing space 56 with an exit orifice 48 defined by bottom wall 46. Second ends 32*a* and 32*b* of conduits 26 and 28 connect to channels 50 and 52 via mouths 54*a* and 54*b*, thereby defining two separate, continuous fluid passages or ports from first and second fluid component syringes 16 and 18 through body portion 12 into cylindrical mixing space 56. The skilled artisan will readily recognize that body portion 12 and insert 14 may be molded from a single piece of material or multiple pieces of material in order to create mixing space 56, channels 50 and 52 and conduits 26 and 28. Cylindrical mixing space 56 may take on other shapes, such as conical for example, without deviating from the scope of the present invention.

Figure 6:
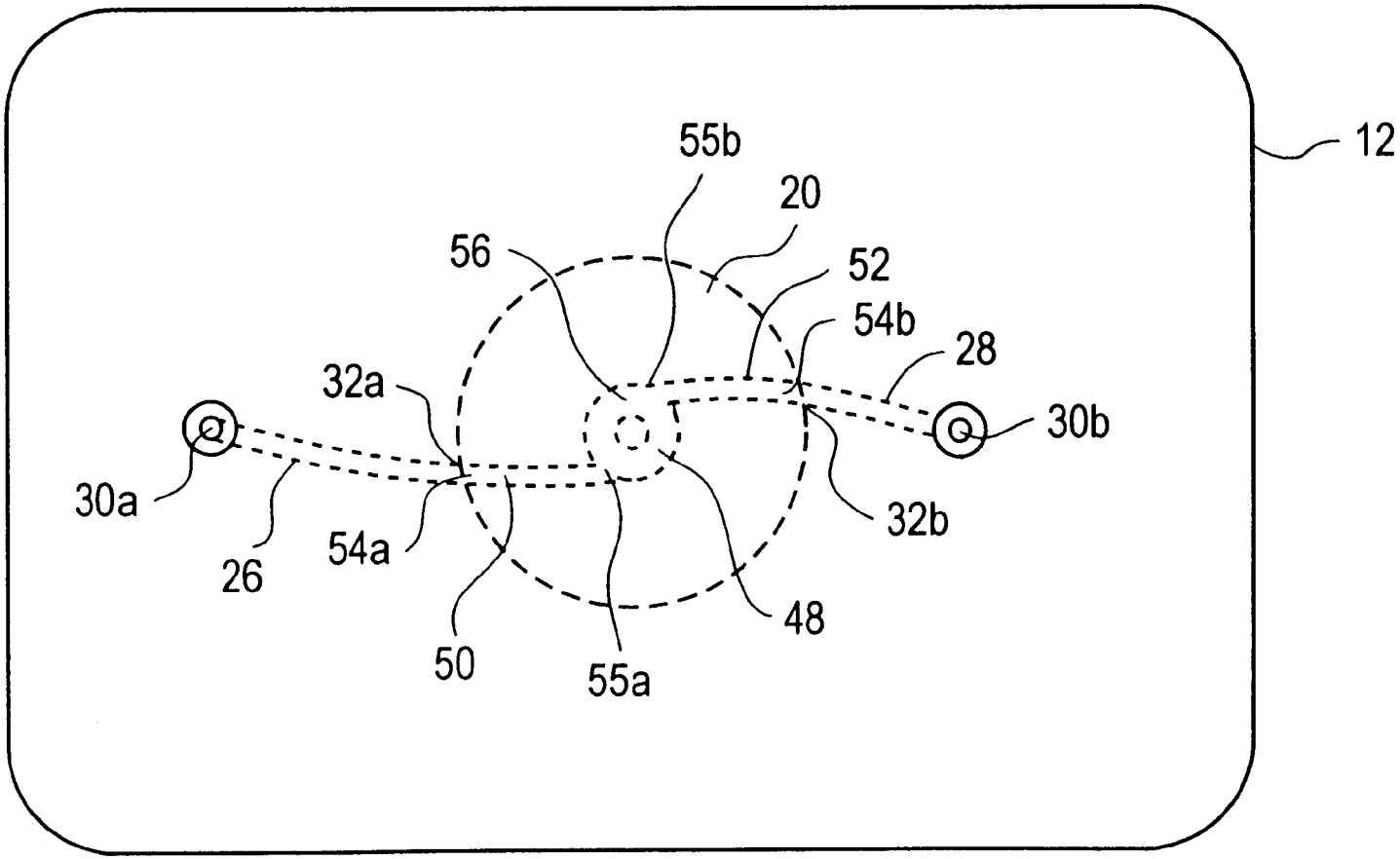
FIG. 6 illustrates, in plan view, the embodiment of the present invention illustrated in FIG. 1.

Referring to FIG. 6, the two fluid components pass through first and second conduits 26 and 28 respectively, through first and second channels 50 and 52 respectively, into mixing space 56, tangent to side wall 44 and from opposite sides of mixing space 56. Side wall 44 imparts a rotational motion to each of the fluid components about the central axis thus, mixing the fluids together. The mixed fluids are ejected out exit orifice 48 in a substantially aerosol form.

It has been found that a device having the dimensions in Table 1 will deliver an even spray pattern of a thoroughly mixed medical adhesive and the device may be used multiple times without clogging, even when several minutes pass between uses (dimensions are best shown in FIGS. 3 and 4).

TABLE 1

| Height A of Wall 44 (in) | Diameter B of Mixing Space 56 (in) | Width E of Openings 55a and 55b (in) | Diameter C of Orifice 48 (in) | Length D of Orifice 48 (in) |
|---|---|---|---|---|
| 0.020 | 0.047 | 0.010 | 0.016 | 0.01 |

In some applications it may be desirable to spray the adhesive onto the target site and in other applications it may be desirable to apply a stream to the target site. While not wishing to be bound by theory, it is believed that a rotating fluid, with sufficient angular momentum, exiting an orifice will atomize upon exit. Therefore, for delivering a mixed medical adhesive in a spray from cylindrical mixing space 56, as shown in FIGS. 5 and 6, it is believed that the ratio of Diameter B (FIG. 4) of mixing space 56 to Width E (FIG. 3) of openings 55*a* and 55*b* should be sufficiently large such that the fluid components rotate about the central axis, but not so large such that the fluids will lose angular momentum before reaching exit orifice 48. It is believed that ratio B:E should be between about 2 to about 5 and preferably about 4, for fluid components having similar viscosities in the range between about 5 and about 30 centipoise and preferably approximately 8 centipoise when injected at approximately 30 p.s.i. (normal delivery pressure expected from syringes).

Again, while not wishing to be bound by theory, it is believed that a fluid having a sufficiently low angular momentum and/or a sufficiently low linear velocity will exit an orifice as a stream. It is believed that increasing length D (FIG. 4) of exit orifice 48 the embodiment described in Table 1 to about 0.04–0.08 in. will sufficiently reduce the angular momentum of the fluid components such that the mixed adhesive will exit as a stream rather than as a spray. Alternatively, it is believed that fixing the ratio B:E between about 1 to about 3 and preferably about 2 allows for sufficient rotation and mixing of the fluid components within mixing space 56 and also allows for delivery of the mixed adhesive as a stream.

Figure 7A:
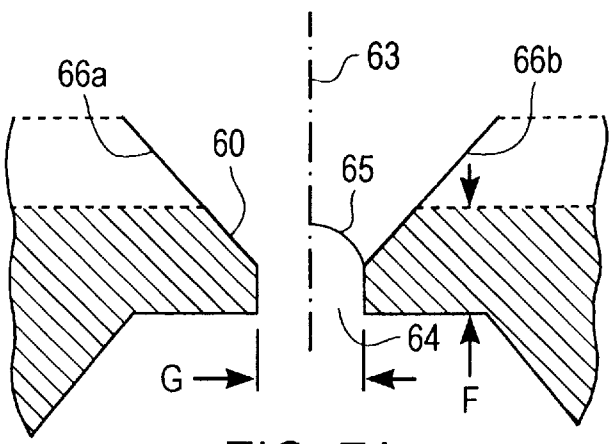
FIG. 7A illustrates an enlarged cross-sectional view of area 7A shown in FIG. 7
Figure 7:
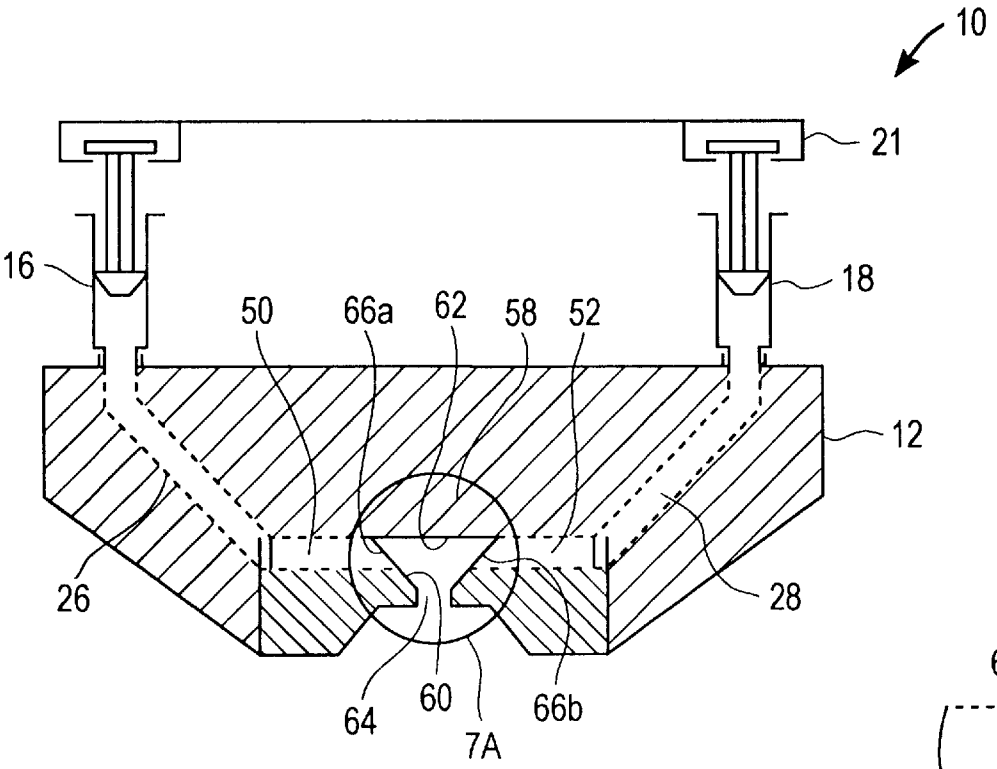
FIG. 7 illustrates, in cross-sectional view, an alternative embodiment of the present invention.

As shown in FIG. 7, an alternative embodiment of medical mixing device 10 utilizes a conically shaped mixing space 58, which is defined by conical side wall 60, upper wall 62 and cylindrical exit orifice 64. Exit orifice 64 has Length F (FIG. 7A) and Diameter G and conical sidewall 60 has interior angle 65 relative to central axis 63 (FIG. 7A). First and second openings 66*a* and 66*b* connect to mixing space 58 tangent to conical side wall 60. Openings 66*a* and 66*b* are in fluid communication with first and second conduits 26 and 28 via channels 50 and 52, thereby defining two separate continuous fluid passages or ports from first and second fluid component syringes 16 and 18 through body portion 12 into conical mixing space 58, as discussed previously. Openings 66*a* and 66*b* have width E equal to the width of channels 50 and 52 as previously described. In this alternative embodiment, it is preferred that entry passages 66*a* and 66*b* have width E of channels 50 and 52, but do not extend the entire height of conical side wall 60. In use, the first and second fluids enter conical mixing space 58 from openings 66*a* and 66*b*, conically shaped side wall 60 imparts rotational flow about the central axis 63 of mixing space 58 causing the two fluid components to thoroughly mix together, and the mixed fluid ejects from exit orifice 64 in an atomized form.

It has been found that a device having the dimensions in Table 2 will deliver an atomized spray of a thoroughly mixed medical adhesive and the device may be used multiple times without clogging. It is believed that increasing length F of exit orifice 64 of the embodiment described in Table 2 to about 0.04–0.08 inches, preferably 0.04 inches, will sufficiently reduce angular momentum of the fluid components such that the mixed adhesive will exit as a stream rather than a spray.

TABLE 2

| Interior Angle 65 | Length F of Exit Orifice 64 (in) | Diameter G of Exit Orifice 64 (in) | Width E of opening 66a and 66b (in) |
|---|---|---|---|
| 30° | 0.015 | 0.010 | 0.03 |

Figure 8:
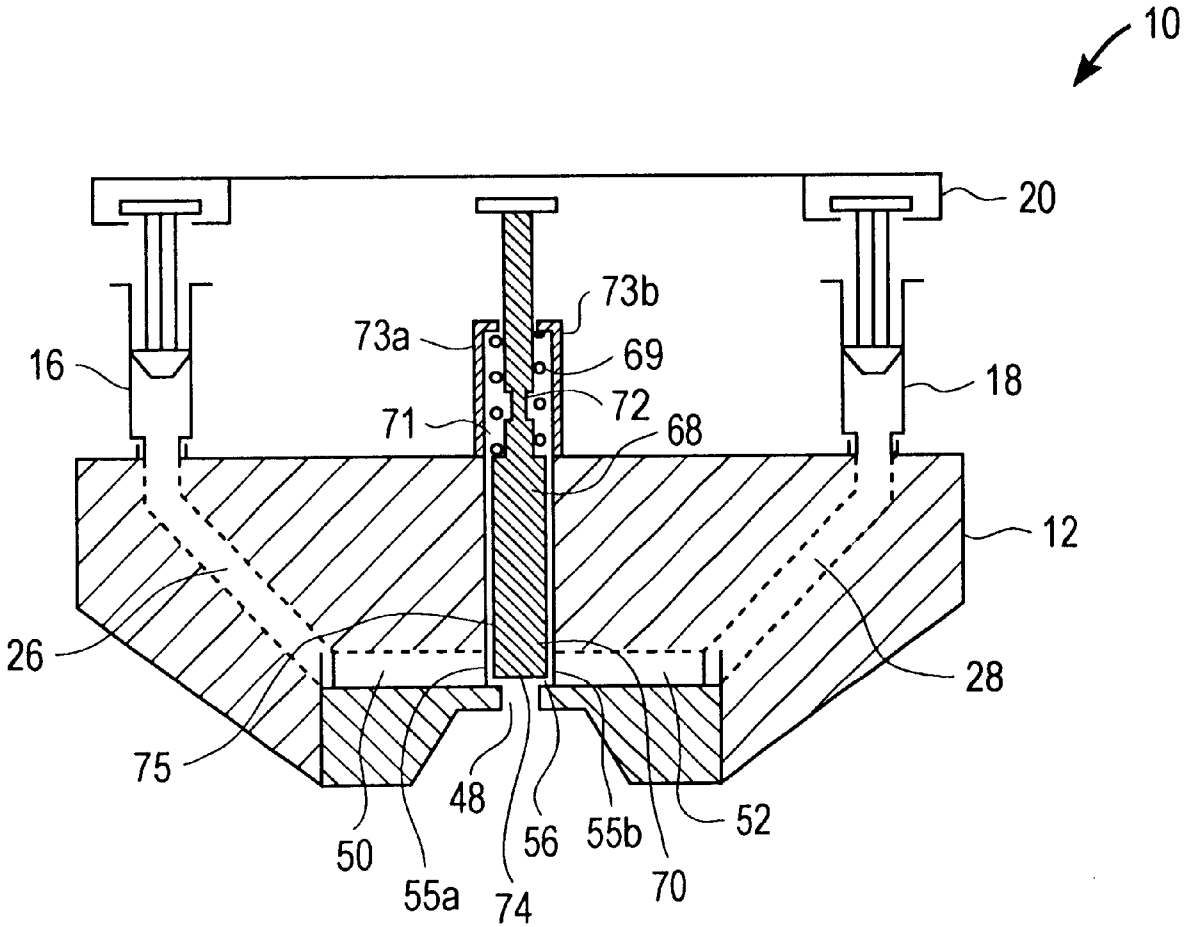
FIG. 8 illustrates, in cross-sectional view, another alternative embodiment of the present invention.

As shown in FIG. 8, an alternative embodiment of medical mixing device 10 includes valve stem 68 slidingly extending through body portion 12, which has an open position and a closed position (shown in closed position). Distal end 70 of valve stem 68 is configured to slide into and substantially occupy mixing space 56 when stem 68 is in the closed position. In the closed position, outer wall 75 of distal end 70 substantially abuts the side wall of mixing space 56, thereby sealing openings 55*a* and 55*b*. Also, when in the closed position tip 74 of distal end 70 substantially abuts bottom wall 46 of mixing space 56. In the open position (not shown), distal end 70 is withdrawn from mixing space 56 such that the two fluid components may enter mixing space 56, as described above. Also in the open position, tip 74 defines the upper wall of mixing space 56.

In use valve stem 68 is slid into the open position, first and second component fluids are injected into mixing space 56, become thoroughly mixed and are ejected from exit orifice 48, as described above. After ejecting the desired amount of mixed adhesive, valve stem 68 is slid into the closed position, thereby forcing substantially all the fluid components remaining in mixing space 56 out exit orifice 48 and sealing openings 55*a* and 55*b*. By forcing out fluid components remaining in mixing space 56, very little, if any, of the fluid components remain in contact with each other within the device, thereby significantly reducing the chances that the device will clog. Also provided is spring 69, which abuts against valve stem 68 at shoulder 71 and against clips 73*a* and 73*b*. Spring 69 is biased to hold valve stem 68 in a closed position. Clips 73*a* and 73*b* lock into notch 72 to hold valve stem 68 in the open position. A skilled artisan will readily recognize that many different mechanisms are well known in the art for actuating and maintaining valve stem 68 in the closed and open positions.

Figure 9:
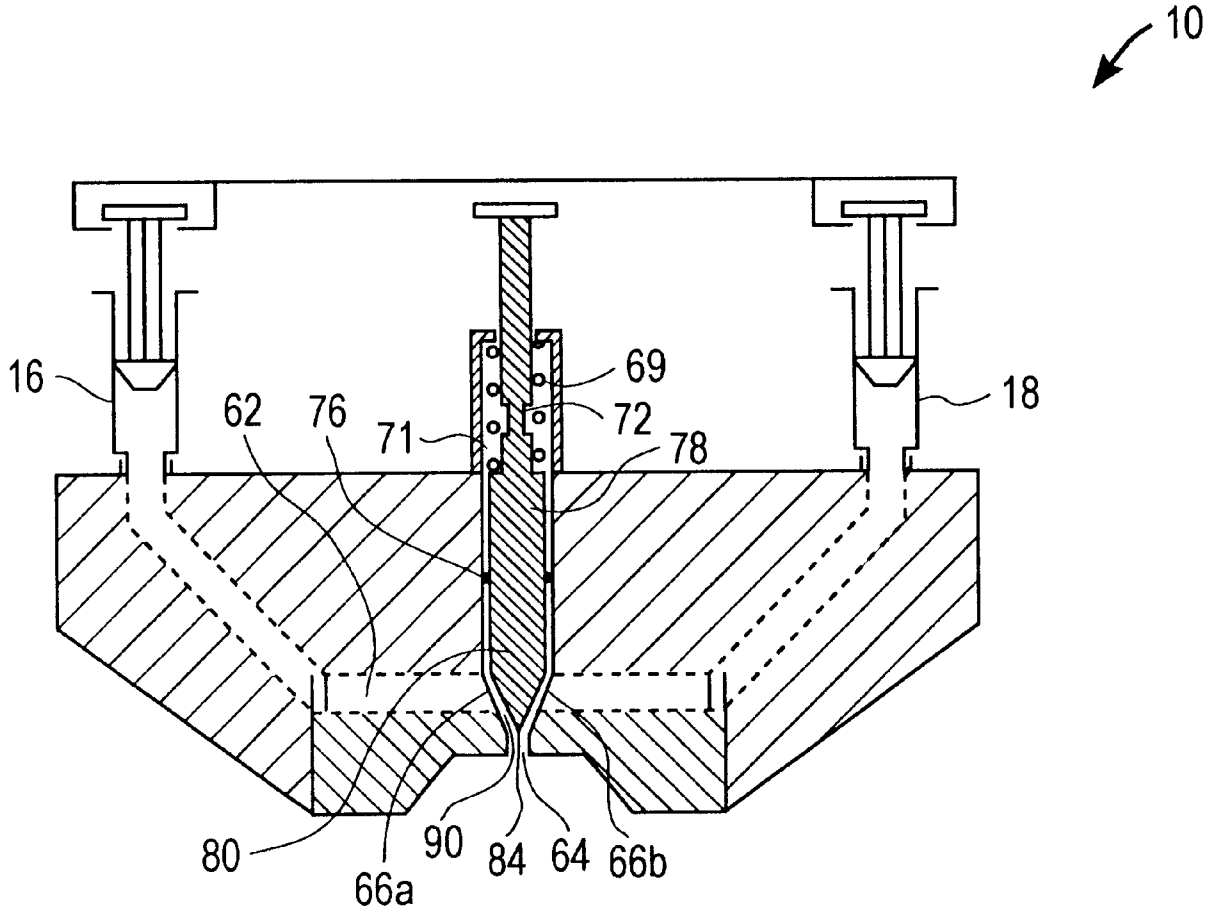
FIG. 9 illustrates, in cross-sectional view, another alternative embodiment of the present invention.

Alternatively, as shown in FIG. 9, mixing space 90 is conically shaped. Valve stem 78 has distal end 80 configured to substantially occupy mixing space 90 in the closed position, such that the outer wall (not shown) of distal end 80 substantially interfaces conical wall 60, thereby sealing openings 66*a* and 66*b*. O-ring 76 is provided adjacent to the distal end to form a seal between valve stem 78 and body portion 12. In the withdrawn or open position, tip 84 defines the upper wall of mixing space 90 and openings 66*a* and 66*b* are open such that the fluid components may enter mixing space 90, as described above.

Although various embodiments of the present invention have been described, the descriptions are intended to be merely illustrative. Thus, it will be apparent to the skilled artisan that modifications may be made to the embodiments as described herein without departing from the scope of the claims set forth below. In particular, the construction of the invention may be from a single piece or from multiple pieces. Additionally, while the embodiments described herein have been described for mixing and ejecting medical adhesives, the skilled artisan will readily recognize that the principles of the present invention apply equally to the mixing and dispensing of multi-component reactive mixtures that will harden in a relatively short period of time.

What is claimed is:

1. An apparatus for mixing and ejecting a multi-component fluid mixture, comprising:

a body portion having a mixing space therein formed around a central axis, said mixing space defined by at least a side wall having a height and an upper wall;

an exit orifice located on said central axis disposed away from said upper wall;

at least two entry ports each having a width defined by said side wall of said mixing space, wherein the width of each entry port is substantially the same as the height of said side wall, and wherein said entry ports are adapted to communicate with at least two separate fluid component sources such that the at least two fluid components separately enter said mixing space and said side wall imparts rotational motion to the at least two fluid components, whereby the at least two fluid components become thoroughly mixed into the multi-component fluid mixture and exit said mixing space through said exit orifice.

2. The apparatus according to claim 1 further comprising:

a valve stem with a distal end and a proximal end, said valve stem movably extending along said central axis having an open position and a closed position, said distal end configured and dimensioned to substantially occupy said mixing space when said valve stem is in the closed position, whereby said distal end seals said at least two entry ports and forces substantially all fluid components remaining in said mixing space out through said exit orifice when said valve stem is in said closed position.

3. The apparatus according to claim 1, wherein said mixing space is defined by said side wall, said upper wall and a lower wall, said lower wall having said exit orifice therein.

4. The apparatus according to claim 3, wherein said mixing space is substantially cylindrical.

5. The apparatus according to claim 4, wherein said at least two entry ports consist of two entry ports, and wherein said two entry ports are tangent to said side wall and enter said mixing space across from each other.

6. The apparatus according to claim 5 further comprising:

a valve stem with a distal end and a proximal end, said valve stem movably extending along said central axis having an open position and a closed position, said distal end configured and dimensioned to substantially occupy said mixing space when said valve stem is in the closed position, whereby said distal end seals said two entry ports and forces substantially all fluid components remaining in said mixing space out through said exit orifice when said valve stem is in said closed position.

7. The apparatus according to claim 5, wherein dimensions of said apparatus are as follows: said side wall has a height (A), said lower wall has a first diameter (B), said exit orifice has a second diameter (C) and a length (D) and said two entry ports have a width (E), and wherein said dimensions are selected in combination such that the multi-component mixture exits in an atomized form from said exit orifice.

8. The apparatus according to claim 7, wherein height (A) is about 0.02 in., first diameter (B) is about 0.047 in., second diameter (C) is about 0.016 in., length (D) is about 0.01 in. and width (E) is about 0.01 in.

9. The apparatus according to claim 7, wherein the ratio of the first diameter (B) to width (E) is between about 2 to about 5 and the ratio of the first diameter (B) to the second diameter (C) is between about 2 to about 4 and the ratio of the second diameter (C) to the length (D) is between about 1 to about 3.

10. The apparatus according to claim 5, wherein, dimensions of said apparatus are as follows: said side wall has a height (A), said bottom wall has a first diameter (B), said exit orifice has a second diameter (C) and a length (D) and said two entry ports have a width (E), and wherein said dimensions are selected in combination such that the multi-component mixture exits in a stream form from said exit orifice.

11. The apparatus according to claim 10, wherein height (A) is about 0.02 in., first diameter (B) is about 0.047 in., second diameter is about 0.016 in., length (D) is about 0.04 in. and width (E) is about 0.01 in.

12. The apparatus according to claim 10, wherein the ratio of the first diameter (B) to width (E) is between about 1 to about 5 and the ratio of the first diameter (B) to the second diameter (C) is between about 3 to about 5 and the ratio of the second diameter (C) to the length (D) is between about 0.5 to about 0.2.

13. The apparatus according to claim 1, wherein said side wall is substantially conically shaped, and said side wall narrows towards said exit orifice.

14. The apparatus according to claim 13, wherein said at least two entry ports consist of two entry ports, and wherein said two entry ports are tangent to said side wall and enter said mixing space across from each other.

15. The apparatus according to claim 14 further comprising:

a valve stem with a distal end and a proximal end, said valve stem movably extending along said central axis having an open position and a closed position, said distal end configured and dimensioned to substantially occupy said mixing space when said valve stem is in the closed position, whereby said distal end seals said two entry ports and forces substantially all fluid components remaining in said mixing space out through said exit orifice when said valve stem is in said closed position.

16. The apparatus according to claim 15, wherein said side wall has an interior angle relative to said central axis, said exit orifice has a diameter and a length and said entry ports have a width, and wherein said angle, said diameter, said length and said width are selected such that said multi-component mixture exits in a substantially atomized form from said exit orifice.

17. The apparatus according to claim 16, wherein said angle is about 30°, said diameter is about 0.010 in., said length is about 0.015 in. and said width is about 0.030 in.

18. The apparatus according to claim 16, wherein said side wall has an interior angle relative to said central axis, said exit orifice has a diameter and a length and said entry ports have a width, and wherein said angle, said diameter, said length and said width are selected such that said multi-component mixture exits in a stream form from said exit orifice.

19. The apparatus according to claim 18, wherein said angle is about 30°, said diameter is about 0.015 in., said length is about 0.040 in. and said width is about 0.03 in.

20. An apparatus for mixing and ejecting a multi-component fluid mixture, comprising:

a body portion having a substantially cylindrical mixing space therein defined by a cylindrical side wall having a height, a lower wall and an upper wall and formed around a central axis;

an exit orifice defined by said lower wall;

at least two entry ports each having a width defined by said cylindrical side wall, wherein the width of each entry port is substantially the same as the height of said side wall, and wherein said entry ports are adapted to communicate with at least two separate fluid component sources and separately provide said fluid components to said mixing space; said entry ports disposed to direct said fluid components entering therethrough against said side wall so as to impart rotational motion to the at least two fluid components, whereby the at least two fluid components become thoroughly mixed into the multi-component fluid mixture and exit said mixing space through said exit orifice.

21. The apparatus according to claim 20, wherein said at least two entry ports consist of two entry ports, and wherein said two entry ports are tangent to said side wall and enter said mixing space across from each other.

22. The apparatus according to claim 21 further comprising:

a valve stem with a distal end and a proximal end, said valve stem movably extending along said central axis having an open position and a closed position, said distal end configured and dimensioned to substantially occupy said mixing space when said valve stem is in the closed position, whereby said distal end substantially seals said two entry ports and forces substantially all fluid components remaining in said mixing space out through said exit orifice when said valve stem is in said closed position.

23. An apparatus for mixing and ejecting a multi-component fluid mixture, comprising:

a body portion having a substantially conical mixing space therein defined by a conical side wall having a height and an upper wall and formed about a central axis;

an exit orifice, wherein said side wall narrows towards said exit orifice;

at least two entry ports each having a width defined by said side wall, wherein the width of entry port is substantially the same as the height of said side wall, said at least two entry ports adapted to communicate with at least two separate fluid component sources such that the at least two fluid components separately enter said mixing space and said side wall imparts rotational motion to the at least two fluid components, whereby the at least two fluid components become thoroughly mixed into the multi-component fluid mixture and exit said mixing space through said exit orifice.

24. The apparatus according to claim 23 further comprising:

a valve stem with a distal end and a proximal end, said valve stem movably extending along said central axis having an open position and a closed position, said distal end configured and dimensioned to substantially occupy said mixing space when said valve stem is in the closed position, whereby said distal end substantially seals said at least two entry ports and forces substantially all fluid components remaining in said mixing space out through said exit orifice when said valve stem is in said closed position.

25. The apparatus according to claim 23, wherein said at least two entry ports comprise two entry ports tangent to said side wall, and wherein said two entry ports enter said mixing space across from each other.

26. An apparatus for mixing and ejecting a multi-component fluid mixture, comprising:

a body portion having a substantially cylindrical mixing space therein defined by a cylindrical side wall having a height, a lower wall and an upper wall and formed around a central axis;

an exit orifice defined by said lower wall;

two entry ports each having a width defined by and tangent to said side wall, wherein each of said entry port's width is substantially the same size as said height of said side wall, and wherein said two entry ports enter said mixing space across from each other;

two fluid component sources fluidly connected to said two entry ports;

means for pressurizing said two fluid component sources, whereby two fluid components separately enter said mixing space, said side wall imparts rotational motion to said two fluid components, said two fluid components become thoroughly mixed into said multi-component fluid mixture and said multi-component fluid mixture exits said mixing space through said exit orifice; and a valve stem with a distal end and a proximal end, said valve stem movably extending along said central axis having an open position and a closed position, said distal end configured and dimensioned to substantially occupy said mixing space when said valve stem is in the closed position, whereby said distal end substantially seals said two entry ports and forces substantially all fluid components remaining in said mixing space out through said exit orifice when said valve stem is in said closed position.

27. An apparatus for mixing and ejecting a multi-component fluid mixture, comprising:

a body portion having a substantially conical mixing space therein defined by a side wall having a height and an upper wall and formed about a central axis;

an exit orifice, wherein said side wall narrows towards said exit orifice;

two entry ports each having a width defined by and tangent to said side wall, wherein the width of each entry port is substantially the same as said height of said side wall, and wherein said two entry ports enter said mixing space across from each other;

at least two fluid component sources fluidly connected to said at least two entry ports;

means for pressurizing said two fluid component sources, whereby at least two fluid components separately enter said mixing space, said side wall imparts rotational motion to said at least two fluid components, said at least two fluid components become thoroughly mixed into said multi-component fluid mixture and said multi-component fluid mixture exits said mixing space through said exit orifice; and a valve stem with a distal end and a proximal end, said valve stem movably extending along said central axis having an open position and a closed position, said distal end configured and dimensioned to substantially occupy said mixing space when said valve stem is in the closed position, whereby said distal end substantially seals said two entry ports and forces substantially all fluid components remaining in said mixing space out through said exit orifice when said valve stem is in said closed position.

28. An apparatus for mixing and ejecting a multi-component fluid mixture, comprising:

a mixing space defined by a substantially circular sidewall formed around a central axis, where said circular side wall has a height and defines at least two entry ports there through, and wherein each entry port has a width that is substantially the same as the height of said side wall; and a lower wall substantially transverse to said central axis, said lower wall defining a central exit orifice there through, such that fluid components entering said mixing space through said entry ports impinge on said side wall to impart a rotational motion to the fluid components, thoroughly mixing the fluid components into a multi-component fluid mixture which exits said mixing space through said exit orifice.

29. The apparatus according to claim 28, wherein said side wall is substantially cylindrical.

30. The apparatus according to claim 28, wherein said side wall is substantially conical.

31. The apparatus according to claim 28, wherein each entry port communicates with a fluid introduction channel and said channel is disposed substantially tangential to the side wall at least at said entry port.

32. The apparatus according to claim 28 further comprising:

a valve stem with a distal end and a proximal end, said valve stem movably extending along said central axis having an open position and a closed position, said distal end configured and dimensioned to substantially occupy said mixing space when said valve stem is in the closed position, whereby said distal end seals said two entry ports and forces substantially all fluid components remaining in said mixing space out through said exit orifice when said valve stem is in said closed position.

* * * * *